US006820425B2

(12) United States Patent
David et al.

(10) Patent No.: US 6,820,425 B2
(45) Date of Patent: Nov. 23, 2004

(54) FUEL INJECTION SYSTEM WITH MULTIPOINT FEED

(75) Inventors: Etienne David, Vulaines sur Seine (FR); Marion Michau, Vincennes (FR); José Rodrigues, Nandy (FR); Denis Sandelis, Nangis (FR); Alain Tiepel, Chailly en Biere (FR)

(73) Assignee: Hispano-Suiza, Colombes (FR)

( * ) Notice: Subject to any disclaimer, the term of this patent is extended or adjusted under 35 U.S.C. 154(b) by 107 days.

(21) Appl. No.: 10/300,817

(22) Filed: Nov. 21, 2002

(65) Prior Publication Data

US 2003/0131600 A1 Jul. 17, 2003

(30) Foreign Application Priority Data

Nov. 21, 2001 (FR) ..... 01 15042

(51) Int. Cl.[7] ..... F02C 7/22
(52) U.S. Cl. ..... 60/743
(58) Field of Search ..... 60/737, 742, 743, 60/748

(56) References Cited

U.S. PATENT DOCUMENTS 3,691,762 A * 9/1972 Ryberg et al. ..... 60/743
3,724,207 A * 4/1973 Johnson ..... 60/743
3,937,011 A * 2/1976 Caruel et al. ..... 60/748
4,222,243 A * 9/1980 Mobsby ..... 60/742
4,425,755 A 1/1984 Hughes
4,606,190 A * 8/1986 Greene et al. ..... 60/748
5,167,116 A 12/1992 Koblish et al.
5,242,117 A * 9/1993 D'Agostino et al. ..... 60/742
5,437,158 A * 8/1995 Fric ..... 60/743
6,035,645 A * 3/2000 Bensaadi et al. ..... 60/742

FOREIGN PATENT DOCUMENTS

FR 2 249 243 5/1975
FR 2 735 214 12/1996

OTHER PUBLICATIONS

Patent Abstracts of Japan, vol. 9, No. 124, May 29, 1985, and JP 60–8610 A, Jan. 17, 1985.

* cited by examiner

*Primary Examiner*—Michael Koczo
(74) *Attorney, Agent, or Firm*—Oblon, Spivak, McClelland, Maier & Neustadt, P.C.

(57) ABSTRACT

A system for injecting an air/fuel mixture into a combustion chamber of a turbomachine, the system having an injector comprising: an axial internal volume opening out at one end via an axial outlet for the air/fuel mixture; a first fuel feed stage having a plurality of first fuel feed orifices which open out into the internal volume, which are distributed around an axis of the injector, and which are connected by fuel feed channels to an inlet for admitting fuel into the injector; and at least one air feed channel which opens out into the internal volume and which is connected to an inlet for admitting air into the injector. The injector further comprises at least one second fuel feed stage with a plurality of second fuel feed orifices which open out into the internal volume, which are distributed around the axis of the injector, and which are connected to said inlet for admitting fuel into the injector via fuel feed channels which coincide at least in part with the fuel feed channels of said first stage.

17 Claims, 3 Drawing Sheets

FUEL INJECTION SYSTEM WITH MULTIPOINT FEED

BACKGROUND OF THE INVENTION

The present invention relates to the general field of systems for injecting fuel into a combustion chamber in a gas turbine engine. The invention relates more particularly to an injection system that includes in particular an aerodynamic fuel injector having multipoint fuel feed.

In conventional manner, the combustion chamber of a gas turbine engine is provided with a plurality of injection systems enabling it to be fed with fuel and air at all of the operating speeds of the engine. The injection systems comprise in particular fuel injectors and air admission means downstream from the injectors. There are two main categories of fuel injector: there are "aeromechanical" injectors designed to deliver two fuel flows depending on engine speed; and there are "aerodynamic" injectors which have a single fuel circuit for use at all engine speeds. In addition, certain "aerodynamic" injectors present air feed channels at the end or "nose" of the injector in order to deliver an air/fuel mixture directly. The present invention relates more particularly to injection systems including socalled "aerodynamic" injectors that also inject air.

The air admission means known in the prior art generally comprise primary and secondary swirlers which deliver a swirling flow of air at the outlet of the fuel injector. A Venturi separating the two swirlers serves to accelerate the flow of air from the primary swirler, and a bowl mounted downstream from the secondary swirler enables the injector to be mounted on the end wall of the combustion chamber while preventing the flame due to combustion of the air/fuel mixture from returning towards the injector.

That type of injection system presents drawbacks. In particular, the air/fuel mixture delivered at the outlet of the injector is generally non-uniform, thus increasing pollution emissions from the engine. The speed at which fuel outlet from the injector flows is also insufficient, in particular at low flow rates, thus running the risk of coking on the nose of the injector and giving rise to non-uniformities in the air/fuel mixture. A low fuel flow speed also has the drawback of increasing the risk of the flame due to combustion of the air/fuel mixture coming back as far as the end of the injector which is prejudicial to proper operation of the gas turbine. In addition, after repeated engine-lighting operations using that type of injection system, traces of coking are found to appear between the injector body and the bowl.

OBJECT AND SUMMARY OF THE INVENTION

The present invention thus seeks to mitigate such drawbacks by proposing an injection system in which the fuel injector enables a more uniform mixture of air and fuel to be obtained and also provides a greater flow speed for the fuel at its outlet.

To this end, the invention provides a system for injecting an air/fuel mixture into a combustion chamber of a turbomachine, the system having an injector comprising: an axial internal volume opening out at one end via an axial outlet for the air/fuel mixture; a first fuel feed stage having a plurality of first fuel feed orifices which open out into the internal volume, which are distributed around an axis of the injector, and which are connected by fuel feed channels to an inlet for admitting fuel into the injector; and at least one air feed channel which opens out into the internal volume and which is connected to an inlet for admitting air into the injector; wherein the injector further comprises at least one second fuel feed stage with a plurality of second fuel feed orifices which open out into the internal volume, which are distributed around the axis of the injector, and which are connected to said inlet for admitting fuel into the injector via fuel feed channels which coincide at least in part with the fuel feed channels of said first stage.

As a result, the second fuel feed stage enables the number of fuel feed points into the inside volume of the injector around the axis thereof to be increased. This has the result of improving the uniformity of air/fuel mixing.

The first and second fuel feed orifices, and also the air feed channel(s) open out into two coaxial passages formed in the internal volume. In an advantageous disposition of the invention, the passage into which the fuel feed orifices open out presents a section that tapers in the fuel flow direction. This characteristic makes it possible to increase the fuel flow speed so as to improve the ability of the injector to withstand coking, and so as to make the sheet of fuel more uniform, particularly at low fuel flow rates.

According to another advantageous disposition of the invention, the second fuel feed orifices are axially offset relative to the first fuel feed orifices. Under such circumstances, the second fuel feed orifices are preferably in angular positions around the axis of the injector that are offset relative to the positions of the first fuel feed orifices. These advantageous dispositions favor distributing fuel around the axis of the injector and thus encourage uniform air/fuel mixing.

According to yet another advantageous disposition of the invention, the fuel feed channels have terminal portions adjacent to the first and second fuel feed orifices that are oriented substantially tangentially relative to the wall of the internal volume. This characteristic makes it possible to set the fuel into rotation in the internal volume, thereby improving the flow speed and the uniformity of air/fuel mixing.

The injector preferably includes a rear part having the air feed channel(s) formed therein, at least one ring in which the first and second fuel feed stages are formed that is inserted in a housing formed at the downstream end of the rear part, and a front part which connects to the rear part, the ring being prevented from moving axially between the rear part and the front part of the injector.

According to another advantageous characteristic of the invention, each fuel feed stage has four fuel feed orifices distributed regularly around the axis of the injector.

The system of the invention further comprises a bushing surrounding at least a portion of the injector, a bowl forming a diverging portion for mounting the injection system on an end wall of a combustion chamber, at least one air swirler interposed between the bushing and the bowl, and a Venturi formed between the bowl and the portion of the injector surrounded by the bushing. An air passage is preferably provided between the bushing and the portion of the injector that is surrounded by the bushing so as to prevent coke forming at the nose of the injector, and air flow holes are formed through the wall of the bowl forming a diverging portion.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
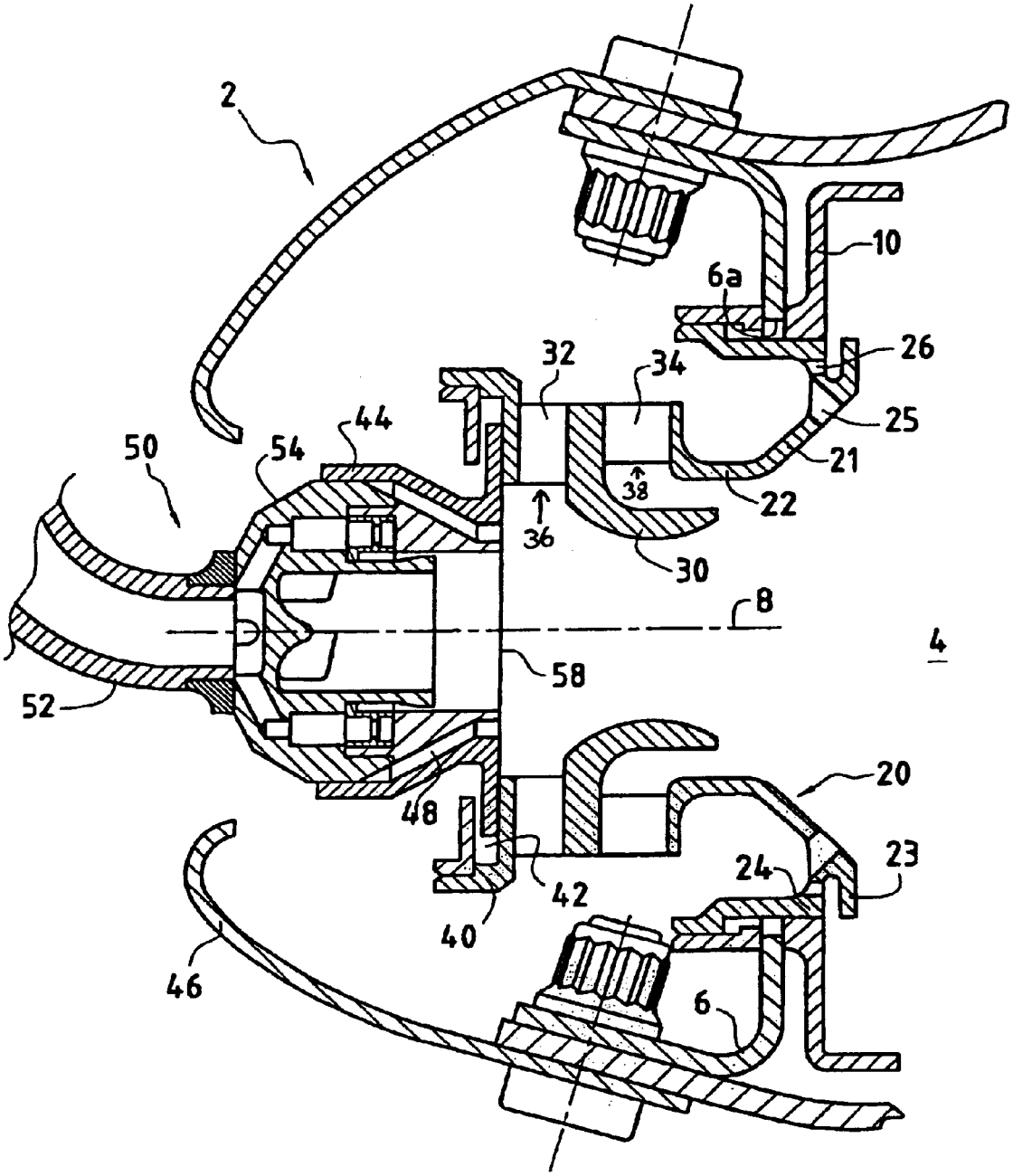
FIG. 1 is a section view of the injection system of the invention mounted in a combustion chamber of a gas turbine engine.

FIG. 1 shows an injection system 2 of the invention mounted in a combustion chamber 4 of a gas turbine engine used in a turbojet, for example.

The combustion chamber 4, e.g. of annular type, is defined by inner and outer walls (not shown in the drawing) united by a chamber end wall 6. The end wall has a plurality of openings 6*a* each having an axis 8, the openings being regularly spaced apart around the axis of the engine. Each opening 6*a* has an injection system 2 of the invention mounted therein to inject an air/fuel mixture into the combustion chamber 4. The gases due to combustion of said air/fuel mixture flow downstream in the combustion chamber 4 and are then exhausted through a high pressure turbine (not shown).

In conventional manner, an annular deflector 10 is mounted in each of the openings 6*a*. This deflector is disposed in the combustion chamber 4 parallel to the end wall 6 of the chamber. A bowl 20 forming a diverging portion is also mounted inside the opening 6*a*. It comprises a wall 21 that flares downstream and that extends a cylindrical wall 22 disposed coaxially about the axis 8 of the opening 6*a*. At its downstream end, the wall 21 of the bowl has a rim 23 which co-operates with a facing wall 24 to define an annular setback or collar for the bowl having a channel section.

The cylindrical wall 22 of the bowl 20 surrounds a Venturi 30 on the axis 8. The Venturi 30 defines the boundaries of air flows coming from a primary swirler 32 and from a secondary swirler 34. The primary swirler 32 is disposed upstream from the Venturi 30 and delivers a flow of air to the inside of the Venturi. The secondary swirler 34 is disposed upstream of the cylindrical wall 22 of the bowl 20 and delivers a flow of air between the Venturi 30 and the cylindrical wall 22.

The upstream end of the primary swirler 32 is secured to a retaining piece 40 which presents an annular groove 42 open towards the axis 8 of the opening 6*a* and in which a bushing 44 is mounted that surrounds at least a portion of the end or nose of a fuel injector 50. The injection system may also be provided with a fairing typically formed by a cap 46. The fairing serves to minimize air losses going round the injector, and to guarantee good feed to the end of the chamber.

The fuel injector 50 of axis X—X coinciding with the axis 8 of the opening 6*a* is of the aerodynamic type, i.e. it delivers only a single flow of fuel regardless of the speed at which the engine is operating. The injector is typically formed by a tubular portion 52 feeding fuel to an injector nose 54 where the fuel mixes with air prior to receiving the air from the primary and secondary swirlers and being injected into the combustion chamber 4.

Reference is now made to FIGS. 2 to 6 which show an embodiment of the fuel injector nose of the injection system of the invention in greater detail.

The injector nose 54 has an axial internal volume 56 which opens out at one end via an axial outlet 58 for the air/fuel mixture. At the end of the nose opposite from its end having the axial outlet 58, there is provided at least one fuel inlet 60 in the form of a cylindrical recess, for example. This inlet 60 is fed with fuel by the tubular portion of the fuel injector. Fuel feed channels 62 open out into the fuel inlet 60 and are connected to a plurality of first fuel feed orifices 64 forming a first fuel feed stage. These first orifices are distributed around the axis X—X of the injector and they open out into the internal volume 56. At least one air feed channel 66 connected to an inlet 68 for admitting air into the injector also opens out into the internal volume 56.

In accordance with the invention, the fuel injector 50 includes at least a second fuel feed stage in its nose 54, this second stage having a plurality of second fuel feed orifices 70 which open out into the internal volume 56. These second orifices are distributed around the axis X—X of the injector and they are connected to the inlet 60 for admitting fuel into the injector via fuel feed channels 72 which coincide at least in part with the fuel feed channels 62 of the first fuel feed stage.

Figure 4:
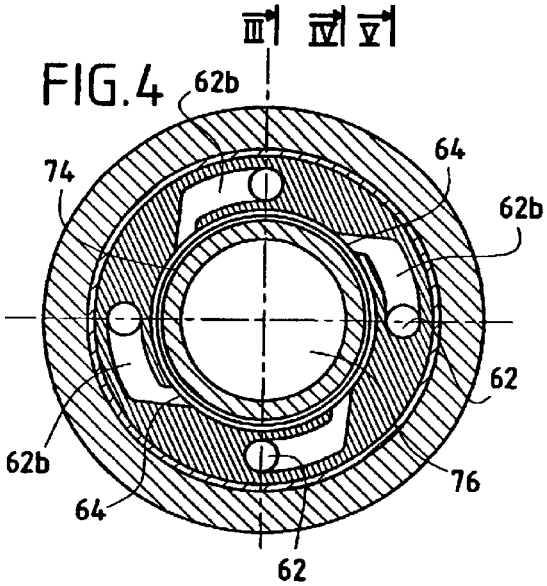
FIGS. 3, 4, and 5 are section views of the nose shown in FIG. 2 respectively on planes III—III, IV—IV, and V—V.
Figure 5:
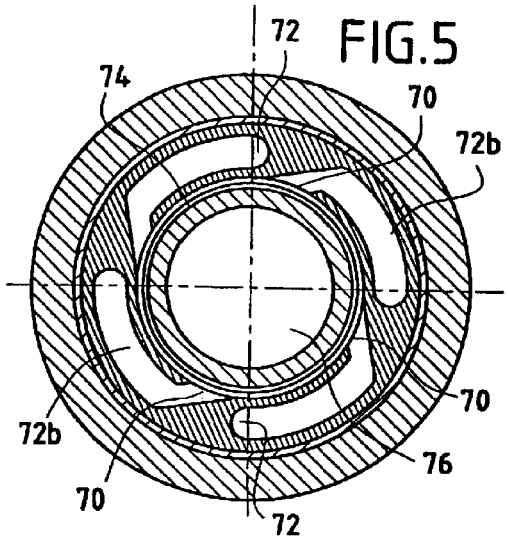

As shown in FIGS. 4 and 5, each fuel feed stage advantageously has four fuel feed orifices 64, 70 connected to the fuel feed channels 62, 72 and distributed uniformly around the axis X—X of the injector. The feed channels 62, 72 are preferably disposed in alternation with four air feed channels 66.

Furthermore, the first and second fuel feed orifices 64 and 70, and also the air feed channel(s) 66 open out into two coaxial passages respectively referenced 74 and 76 formed in the internal volume 56. More precisely, the air feed channels 66 open out into a central passage 76, and the first and second fuel feed orifices open out into an annular passage 74 surrounding the central passage 76.

According to an advantageous characteristic of the invention, the annular passage 74 into which the fuel feed orifices open out presents a reduction in section 74*a* in the fuel flow direction so as to form a converging portion enabling the fuel to be accelerated as it leaves via said annular passage.

Furthermore, as shown in FIGS. 2 to 7, the second fuel feed stage can be axially offset from the first stage so that the second fuel feed orifices 70 are axially offset from the first fuel feed orifices 64. This offset between the fuel feed stages can be provided when, for reasons of space, it is not possible to place all of the feed orifices 64, 70 in the same axial plane. Under such circumstances, the second fuel feed orifices 70 are preferably in angular positions around the axis X—X of the injector that are offset relative to the positions of the first fuel feed orifices 64. As a result, the distribution of fuel around the axis of the injector, and thus the uniformity of air/fuel mixing, are improved.

Figure 2:
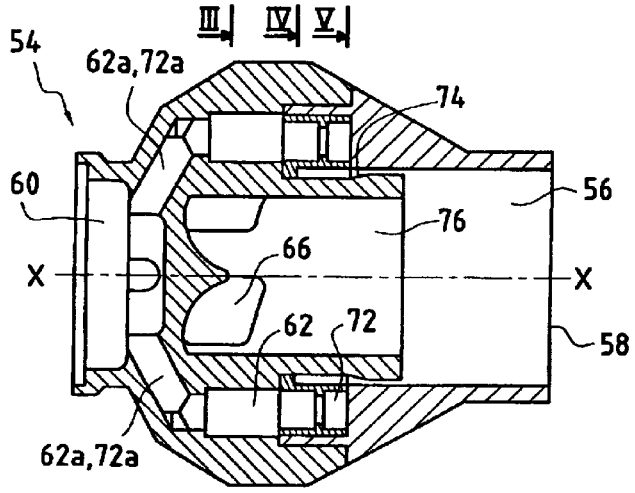
FIG. 2 is a longitudinal section view of an embodiment of the fuel injector nose forming part of the injection system of the invention.

Each of the fuel feed channels 62, 72 has a first portion, respectively referenced 62*a* or 72*a*, inclined relative to the axis X—X of the injector and connected to the inlet 60 for admitting fuel into the injector, and a second portion, respectively referenced 62*b* or 72*b*, which connects the first portion to a fuel feed orifice 64, 70. In FIG. 2, it can clearly be seen that the first portions 62*a*, 72*a* of the fuel feed channels 62, 72 coincide, at least in part. As shown in FIGS. 4 and 5, in their terminal portions adjacent to the first and second fuel feed orifices 64 and 70, these fuel feed channels are oriented substantially tangentially relative to the wall of the internal volume 56. The fuel flowing in these channels is thus set into rotation prior to being introduced into the internal volume, thereby enabling its flow speed to be increased and thus enhancing the uniformity of air/fuel mixing.

Figure 6:
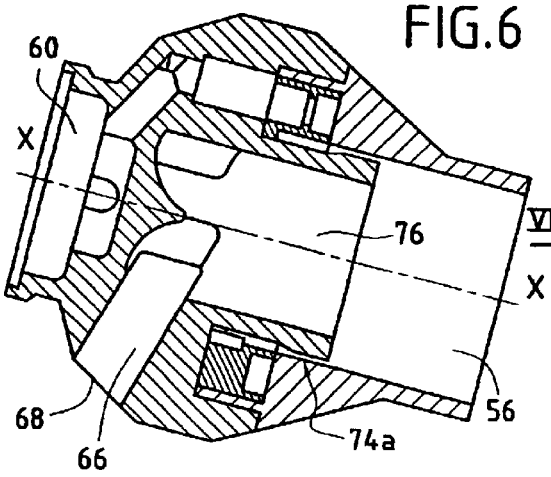
FIG. 6 is a section view on VI—VI of FIG. 3.
Figure 3:
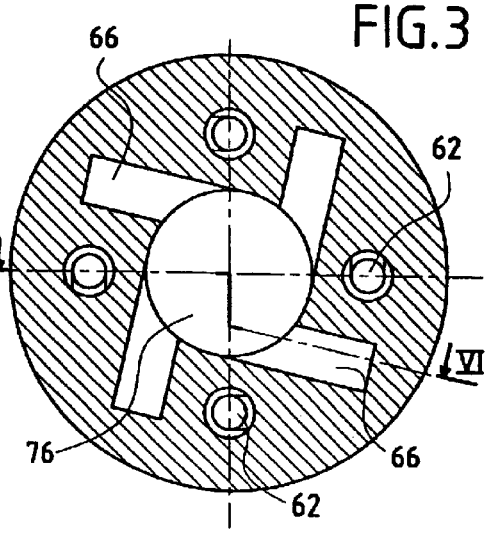

The layout of the air feed channel(s) 66 is shown in greater detail in FIGS. 3 and 6. These channels open out into the internal volume 56 in a direction which is substantially tangential relative to the wall of the internal volume and which slopes downstream relative to a plane normal to the axis X—X of the injector. This particular layout also improves uniformity and flow speed of the air/fuel mixture.

Figure 7:
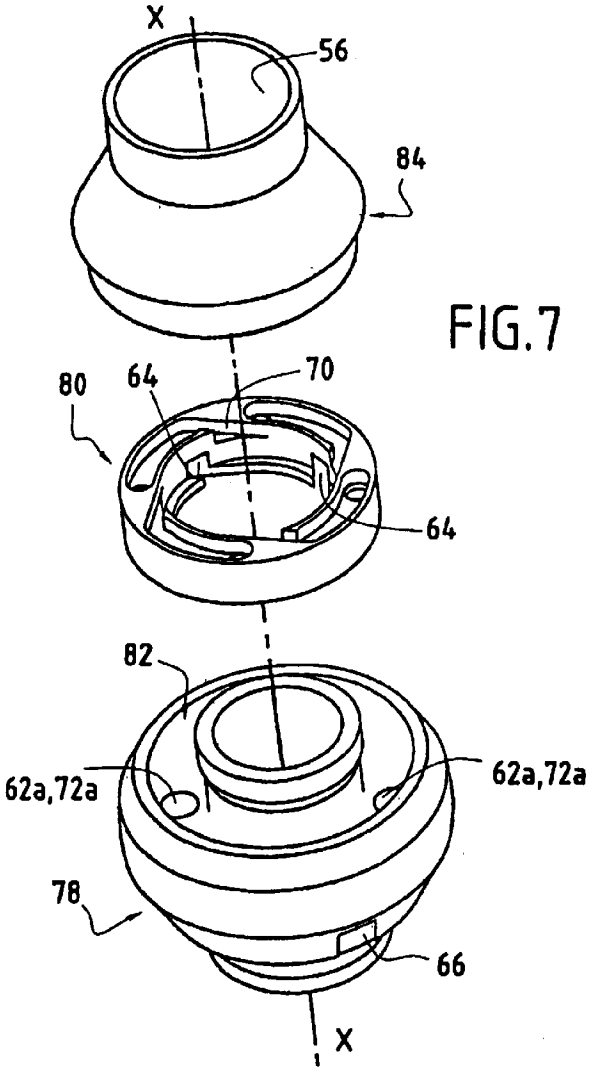
FIG. 7 is an exploded perspective view of the FIG. 2 injector nose.

The elements constituting the injector nose as listed above are described below in greater detail with reference to FIG. 7 which is a diagrammatic exploded perspective view of the nose 54 of the fuel injector 50.

In this figure, it can be seen that the injector nose essentially comprises three parts: a rear part 78 in which the air feed channel(s) 66 is/are formed; at least one ring 80 in which the first and second fuel feed stages are formed and which is introduced into a housing 82 formed at the downstream end of the rear part; and a front part 84 which connects to the rear part, the ring being prevented from moving axially between the rear part and the front part.

In the embodiment shown in FIGS. 2 to 7, the injector nose has two fuel feed stages in the ring 80. Naturally, it is possible to devise an injector nose, and more particularly a ring 80, having more than two fuel feed stages so as to further increase the number of fuel feed points into the internal volume of the injector. Under such circumstances, the additional stages can be axially offset from one another so as to increase the number of fuel feed points into the internal volume of the injector.

Other advantageous characteristics of the injection system of the invention are shown in FIG. 1. In this figure, it can be seen that at least one air passage is provided between the bushing 44 and the portion of the nose that is surrounded thereby. This passage makes it possible to provide anticoking purging, i.e. it prevents fuel from coking at the nose of the injector, particularly at low fuel flow rates. This air passage can be made, for example, in the form of a plurality of orifices 48 regularly distributed around the nose and opening out in the vicinity of the axial outlet 58 therefrom in a direction that is substantially parallel to the axis X—X of the injector 50. In order to accelerate the flow of air passing through these orifices 48, the section of said passage may decrease in the air flow direction.

In addition, air flow holes 25 are formed through the wall 21 of the bowl 20 so as to provide an anticoking purge at the bowl. These holes 25 open out into the combustion chamber in a direction which may be inclined relative to the axis X—X and be tangential relative to the flared wall 21 of the bowl so as to avoid any risk of coking.

Likewise, air flow holes 26 are formed through the facing wall 24 of the bowl collar so as to feed it, and more particularly the annular deflector 10, with air. These holes 26 open out, for example, in a manner that is substantially parallel to the axis X—X of the injector so that the air passing through them strikes the rim 23 of the bowl wall 21 and flows along the annular deflector 10.

Figure 8:
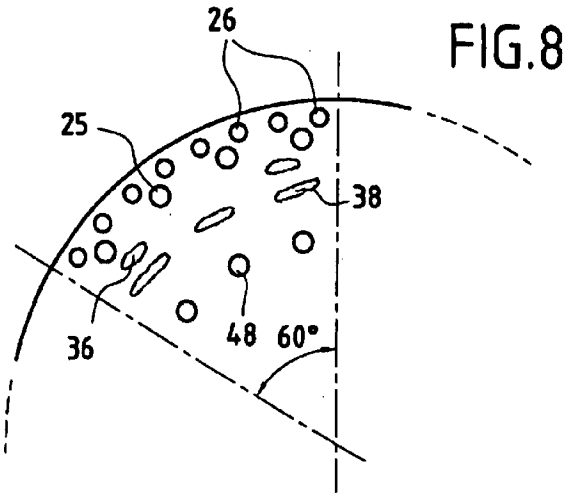
FIG. 8 is a diagram showing an example of a layout for the various passages feeding the FIG. 1 injection system with air.

The air flow holes 25 and 26 and orifices 48 in the various elements of the injection system, and also air slots 36, 38 respectively for the primary and secondary swirlers 32, 34 can be distributed over N angular sectors each occupying 360°/N. More precisely, for each angular sector, the bowl 20 may be provided, for example, with n air flow holes 25 of identical shape (e.g. circular, elliptical, . . . ) opening out parallel to one another. The same principle can be adopted for the other air flow holes and slots. By way of example, FIG. 8 is a diagram showing one possible layout for these various air passages in a plane P perpendicular to the axis X—X. In this figure, there are shown only the air passages occupying an angular sector of 600; they comprise: three orifices 48 formed between the bushing 44 and the portion of the nose surrounded thereby; two air slots 36 for the primary swirler; three air slots 38 for the secondary swirler; four air flow holes 25 formed in the wall 21 of the bowl; and eight air flow holes 26 formed in the facing wall 24 of the bowl collar. The layout of these various air passages is regular around the axis X—X. They may be made directly by casting.

What is claimed is:

1. A system for injecting an air/fuel mixture into a combustion chamber of a turbomachine, the system having an injector comprising:

an axial internal volume opening out at one end via an axial outlet for the air/fuel mixture;

a first fuel feed stage having a plurality of first fuel feed orifices which open out into the internal volume, which are distributed around an axis of the injector, and which are connected by fuel feed channels to an inlet for admitting fuel into the injector; and at least one air feed channel which opens out into the internal volume and which is connected to an inlet for admitting air into the injector, wherein the injector further comprises at least one second fuel feed stage with a plurality of second fuel feed orifices which open out into the internal volume, which are distributed around the axis of the injector, and which are connected to said inlet for admitting fuel into the injector via fuel feed channels which coincide at least in part with the fuel feed channels of said first stage, and wherein the second fuel feed orifices are axially offset from the first fuel feed orifices.

2. A system according to claim 1, wherein the first and second fuel feed orifices, and the air feed channels open out into two coaxial passages formed in the internal volume.

3. A system according to claim 2, wherein the passage into which the fuel feed orifices open out presents a section that decreases in the fuel flow direction so as to accelerate the flow of fuel in the internal volume.

4. A system according to claim 2, wherein the at least one air feed channel opens out into a central passage, and the fuel feed orifices open out into an annular passage surrounding the central passage.

5. A system according to claim 1, wherein the second fuel feed orifices occupy angular positions around the axis of the injector that are offset from the positions occupied by the first fuel feed orifices.

6. A system according to claim 1, wherein the terminal portions of the fuel feed channels adjacent to the first and second fuel feed orifices are oriented substantially tangentially relative to the wall of the internal volume.

7. A system according to claim 1, wherein the fuel feed channels comprise respective first portions inclined relative to the axis of the injector and connected to the inlet for admitting fuel into the injector, and respective second portions connecting the first portions to respective fuel feed orifices.

8. A system according to claim 7, wherein the first portions of the fuel feed channels connected to the first fuel feed orifices and the first portions of the fuel feed channels connected to the second fuel feed orifices coincide, at least in part.

9. A system according to claim 1, wherein the at least one air feed channel opens out into the internal volume in a direction which is substantially tangential relative to the wall of the internal volume and which is inclined downstream relative to a plane normal to the axis of the injector.

10. A system according to claim 1, wherein the injector comprises:

a rear part in which the at least one air feed channel is formed;

at least one ring in which the first and second fuel feed stages are formed and which is introduced in a housing formed at the downstream end of the rear part; and a front part connected to the rear part, the ring being prevented from moving axially between the rear part and the front part of the injector.

11. A system according to claim 1, wherein each fuel feed stage has four fuel feed orifices regularly distributed around the axis of the injector.

12. A system according to claim 1, further comprising a bushing surrounding at least a portion of the injector, a bowl forming a diverging portion for mounting the injection system on an end wall of a combustion chamber, and at least one air swirler interposed between the bushing and the bowl.

13. A system according to claim 12, wherein at least one air passage is provided between the bushing and the portion of the injector surrounded by said bushing.

14. A system according to claim 12, wherein a Venturi is formed between the bowl and the portion of the injector surrounded by the bushing.

15. A system according to claim 12, having two air swirlers, namely a primary swirler and a secondary swirler.

16. A system according to claim 12, wherein air flow holes are formed through the wall of the bowl that forms a diverging portion.

17. A system according to claim 12, wherein the downstream end of the bowl has a rim which co-operates with a facing wall to define an annular channel-section setback, and air flow holes are formed through said facing wall in order to feed air into said setback.

* * * * *